US006519987B1

(12) United States Patent
Weyerstall

(10) Patent No.: US 6,519,987 B1
(45) Date of Patent: Feb. 18, 2003

(54) MOTOR VEHICLE DOOR LOCK SYSTEM WITH PASSIVE ENTRY FUNCTION AND HIGH-SPEED UNLOCKING

(75) Inventor: Bernd Weyerstall, Wuppertal (DE)

(73) Assignee: Brose Schliesssysteme GmbH, Coburg (DE)

( * ) Notice: Subject to any disclaimer, the term of this patent is extended or adjusted under 35 U.S.C. 154(b) by 137 days.

(21) Appl. No.: 09/657,096

(22) Filed: Sep. 7, 2000

(30) Foreign Application Priority Data

Sep. 7, 1999 (DE) ..... 199 42 485

(51) Int. Cl.[7] ..... E05B 47/02

(52) U.S. Cl. ..... 70/257; 70/264; 70/277; 70/280; 292/201

(58) Field of Search ..... 70/257, 263–265, 70/256, 277, 280; 292/201

(56) References Cited

U.S. PATENT DOCUMENTS

| | | | | | |
|---|---|---|---|---|---|
| 4,794,268 | A | * | 12/1988 | Nakano et al. | 70/257 X |
| 4,811,013 | A | * | 3/1989 | Akutsu | 70/257 X |
| 4,897,644 | A | * | 1/1990 | Hirano | 70/257 X |
| 5,240,296 | A | | 8/1993 | Kobayashi | 292/201 |
| 5,497,641 | A | * | 3/1996 | Linde et al. | 70/257 |
| 5,697,236 | A | * | 12/1997 | Kleefeldt et al. | 70/257 |
| 5,887,466 | A | * | 3/1999 | Yoshizawa | 70/257 |
| 6,062,613 | A | | 5/2000 | Jung et al. | 292/201 |
| 6,116,664 | A | * | 9/2000 | Wegner | 292/201 X |
| 6,142,540 | A | * | 11/2000 | Girard et al. | 292/201 X |
| 6,188,141 | B1 | * | 2/2001 | Daviaud | 70/257 X |
| 6,286,878 | B1 | * | 9/2001 | Hochart et al. | 70/257 X |

FOREIGN PATENT DOCUMENTS

| | | | | |
|---|---|---|---|---|
| DE | 195 21 024 | | 12/1996 | |
| DE | 196 27 246 | | 1/1997 | |
| DE | 196 17 038 | | 11/1997 | |
| DE | 196 29 709 | | 1/1998 | |
| DE | 197 52 974 | | 9/1998 | |
| EP | 0 589 158 | | 3/1994 | |
| EP | 0 922 826 | | 6/1999 | |
| EP | 1 001 118 | | 5/2000 | |
| EP | 1 001 119 | | 5/2000 | |
| JP | 4076174 | * | 3/1992 | 70/257 |
| WO | WO 99/19585 | | 4/1999 | |

* cited by examiner

*Primary Examiner*—Lloyd A. Gall
(74) *Attorney, Agent, or Firm*—Nixon Peabody LLP; David S. Safran

(57) ABSTRACT

A motor vehicle door lock system including a vehicle lock adapted to be locked and unlocked, a lock element adapted to be moved between a locked position and an unlocked position for locking and unlocking respectively the vehicle lock, a central interlock drive having a slow running drive element for moving the lock element, a remote control module, control electronics with a passive entry function to at least passively unlock the vehicle lock, and a high-speed electromagnetic drive for rapidly moving the lock element from the locked position to the unlocked position to thereby unlock the vehicle lock quicker than by operating the drive element. The passive unlocking of the vehicle lock occurs over time requiring a reaction phase with a starting interval, an authorization check interval, and an action interval, the starting interval being initiated by an operator. The high-speed electromagnetic drive is immediately activated at start of the action interval, and subsequent to the activation, the central interlock drive is operated to move the slow running drive element to a position corresponding to the unlocked position of the lock element.

3 Claims, 3 Drawing Sheets

MOTOR VEHICLE DOOR LOCK SYSTEM WITH PASSIVE ENTRY FUNCTION AND HIGH-SPEED UNLOCKING

BACKGROUND OF THE INVENTION

1. Field of the Invention

The invention relates to a motor vehicle door lock system with a vehicle lock which can be locked and unlocked by a motor and which can be opened mechanically or by a motor. In particular, the invention relates to such a door lock system having control electronics with a passive entry function.

2. Description of Related Art

Conventional electromechanical motor vehicle door lock systems having a radio remote control but without the passive entry function are generally known. In these conventional vehicle door lock systems, the operator presses a button on the remote control module. This activates the control electronics which passes through its reaction phase immediately. Because of the distance of the operator from the vehicle door, by the time the operator reaches the outside door handle on the motor vehicle door, the reaction phase of the control electronics has long been completed and the motor vehicle lock has been unlocked. By pulling on the outside door handle, the operator opens the motor vehicle door and the motor vehicle lock is opened either mechanically so that the detent pawl is lifted by the motion of the outside door handle, or electromechanically or pneumatically, the outside door handle delivering a control signal to the opening drive to raise the detent pawl.

One such conventional electromechanical motor vehicle door lock system is known, for example, from U.S. Pat. No. 5,240,296. The lock element here is driven by an electric motor-operated central interlock drive with an electric drive motor and worm gear pair. The worm wheel of the worm gear pair is the drive element of the central interlock system. These electromechanical motor vehicle door lock systems of the type disclosed in the '296 patent run rather slowly and moving the lock element from the locking position into the unlocking position by means of the central interlock drive takes at least 50 ms or even longer. Despite the slow operation, various embodiments of these electromechanical motor vehicle door lock systems have become known, as shown in U.S. Pat. No. 6,062,613.

Control electronics with a passive entry function, also known as an "electronic key", differ from the above explained conventional motor vehicle door lock systems in that on the remote control module, no manipulation is necessary. Therefore a button need not be pressed to unlock the motor vehicle lock when approaching the motor vehicle. Rather this takes place all by itself when the operator approaches the motor vehicle.

A motor vehicle door lock system with a passive entry function for the control electronics requires a certain reaction phase which includes a starting interval to activate the system as the remote control module approaches, an authorization check interval to check the operator for his authorization by using the coding of the signals exchanged between the remote control module and the control electronics, and finally, the actual action interval in which the action such as the unlocking of the motor vehicle lock takes place. A corresponding reaction phase is also required when locking the vehicle door lock system. However, this corresponding reaction phase is less critical because it is essentially unnoticed by the operator.

The length of the reaction phase of roughly 150 ms (as compared to conventional motor vehicle door lock systems) is perceived as being long if the starting interval is begun only when the outside door handle is activated. Pulling the outside door handle or the like occur in a passive entry function under certain circumstances when the reaction phase of the control electronics has not yet been completed. In such occurrences, the operator can then become annoyed that he/she must pull the door handle a second time and this is interpreted as a "malfunction".

Since the resulting total time of the reaction phase cannot be shortened as much as desired, attempts have already been made to conceal the delay time. The published German patent application DE-A- 195 21 024 discloses a motor vehicle door lock system in which the starting interval and the authorization check interval of the control electronics are shifted into a phase which precedes the actual operation phase which is noticeable to the operator. Then, only the remaining time which corresponds to the reaction time of mechanical, conventional motor vehicle door lock system is noticeable to the operator.

A different solution is to have the starting interval of the control electronics initiated not only when the outside door handle is activated, but to use the approach of the hand of an operator to the outside door handle to initiate the starting interval. To do this, the provision of a proximity sensor on the outside door handle is known as disclosed in the published German patent applications DE-A-197 52 974 and DE-A-196 17 038. In these references, there is approximately 100 to 150 ms between the sensing of the approaching hand of the operator and the hand actually touching the outside door handle. The starting interval of the control electronics, i.e., the "awakening" of the control electronics, therefore begins so far prior to the actual pulling of the outside door handle that the starting interval, and usually also the authorization check interval, are already completed when the outside door handle is in fact moved by the hand of the operator.

The use of proximity sensors in motor vehicle door lock systems of the type under consideration entails various difficulties. On the one hand, the proximity sensors have a comparatively high closed-circuit current and on the other hand, it is difficult to set a stable, unequivocal response threshold for such proximity sensors. External effects such as rain, snow, dirt and dust greatly change the measured values in capacitive proximity sensors. Finally, in proximity sensors, the problem of the interfering electromagnetic radiation which they emit cannot be ignored. Therefore, despite their disadvantages, motor vehicle door lock systems with a passive entry function in which only actuation of the outside door handle by the hand of an operator begins the starting interval of the control electronics noted previously have major advantages over systems that utilize proximity sensors.

As evident from the above, in motor vehicle door lock systems with a passive entry function in all their various forms explained above, the primary problem lies in shortening the reaction phase of the control electronics as much as possible, at least with respect to the delay perceived by the operator. Therefore, there exists an unfulfilled need for a motor vehicle door lock system with a passive entry function which minimizes the reaction phase of the control electronics, at least with respect to the delay perceived by the operator.

SUMMARY OF THE INVENTION

The primary object of the present invention is to provide a motor vehicle door lock system with a passive entry function which minimizes the reaction phase of the control electronics, at least with respect to the delay perceived by the operator.

This and other objects are obtained by a motor vehicle door lock system in accordance with the present invention in which, in addition to the central interlock drive, an additional electromagnetic high-speed drive for the lock element is assigned to the motor vehicle lock. Whether this high-speed drive directly engages the lock element or other components of the motor vehicle lock which are coupled to the lock element, for example a rod which leads to the inside safety buttons, is not critical to practice the present invention. To practice the present invention, the unlocking position of the lock element and thus, of the entire motor vehicle lock, is reached within a few milliseconds such as approximately 10 ms, after the completion of the authorization check interval by means of the high-speed electromagnetic drive. With the slight additional cost in the motor vehicle lock incurred by the use of a high-speed electromagnetic drive in the form of a lifting magnet, a major improvement in ease of use for the operator is achieved. Instead of 150 ms required in the best possible case of a passive entry system of the existing designs, the reaction phase is now only 100 to 110 ms.

It is significant that the central interlock drive is built in the conventional manner with a slow running drive element. This central interlock drive is however, followed up with the inevitable time delay and after a slightly longer time interval, is then in its readiness position for the next function. The position of the high speed drive on the one hand and the central interlock drive on the other, are then again synchronized.

The teaching of the invention can be used in an especially valuable manner when, as already explained in the prior art, the starting interval is initiated by the hand of the operator actually activating the outside door handle such as by touching it. As discussed previously, although this type of system eliminates the need for a proximity sensor, it has a disadvantage in that the additional time available in systems with proximity sensors is no longer available. However, the present invention can also be readily applied to motor vehicle door lock systems which is equipped with a proximity sensor to further shorten the reaction phase of the control electronics, at least with respect to the delay perceived by the operator.

The teaching of the invention can also be integrated in an especially feasible manner in existing classical electromechanical motor vehicle door lock systems without major additional cost so that in the existing designs the passive entry function can be used without disadvantages in the ease of actuation.

The teaching of this invention can also be used especially advantageously when the motor vehicle door lock is made as an electric lock which is activated by sensors in the lock mechanism. In such systems, chains of dynamic effect from the outside door handle, from the inside door handle, and optionally, from the lock cylinder into the lock mechanism, are used solely for actuation of the corresponding switches or to influence the corresponding sensors. However, if necessary, the lock mechanism can be used for purposes of actuation of the detent pawl, etc. based on the existence of the chains of dynamic mechanical effects as discussed in a commonly owned, co-pending patent application which claims priority to the German patent application number 199 24 447.

These and other objects, features and advantages of the present invention will become more apparent from the following detailed description of the preferred embodiments of the invention when viewed in conjunction with the accompanying drawings.

DETAILED DESCRIPTION OF THE PREFERRED EMBODIMENT

Figure 1:
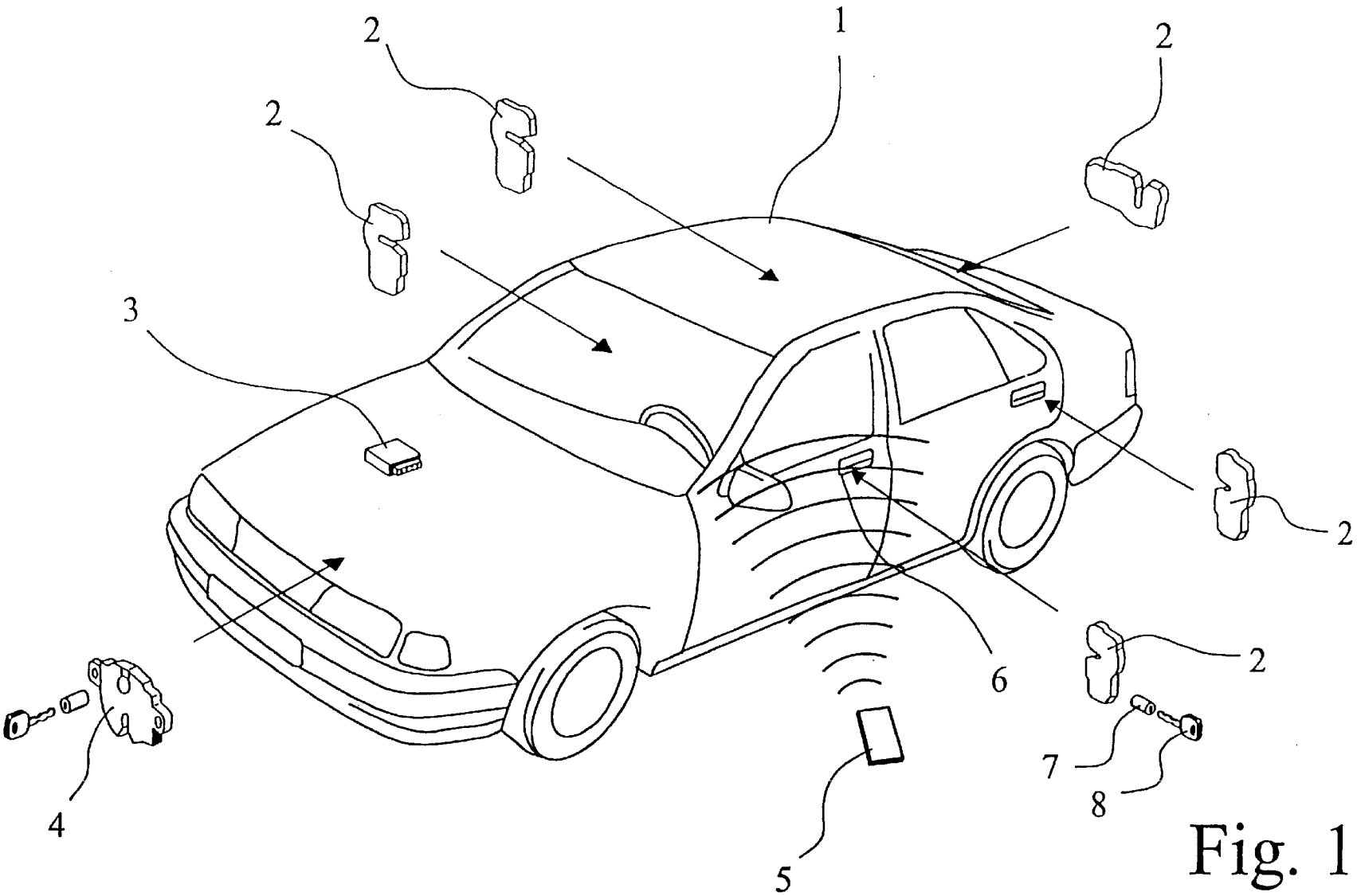
FIG. 1 shows in a schematic and perspective view of a motor vehicle having a door lock system in accordance with the present invention.

The motor vehicle 1 which is shown schematically in FIG. 1 has a vehicle door lock system in which the various vehicle locks 2 for the vehicle doors and vehicle hatches are shown schematically in their installation position. Each motor vehicle lock 2 can be locked and unlocked by a motor, preferably an electric motor (not shown), and likewise in other embodiments, by means of a central interlock drive (not shown). In the illustrated embodiment of the motor vehicle 1 utilizing an electric lock as shown in FIG. 1, the motor vehicle lock 2 additionally has the possibility of motorized opening, therefore lifting of the detent pawl (not shown), by means of an opening drive (not shown). In this case, the locking and unlocking can also be done only using circuitry (not shown). In an alternative embodiments, the motor vehicle 1 includes motor vehicle locks 2 with an auxiliary closing drive (not shown) which can be identical to the opening drive or can be separate from it. In this regard, the teachings of the art references, such as the German patent application DE-A-196 29 709, etc. is noted for disclosing details of the various components noted above that are generally known in the art. The details of these various components are, however, omitted here to avoid repetition.

As can also be seen in FIG. 1, the motor vehicle door lock system in accordance with the present invention includes control electronics 3 which is shown here as the central control electronics, but which can also be assigned in a decentralized manner to each of the motor vehicle locks 2. In the embodiment shown, there are also provided a hood lock 4 which can be operated with a key for the hood of the vehicle 1, and a remote control module 5 which is in the form of a passive entry chipcard. The control electronics 3 works to provide a passive entry function, therefore, with an "electronic key". In this regard, reference is further made to the aforementioned prior art, the details of which having been discussed previously and omitted here to again avoid repetition.

Figure 2:
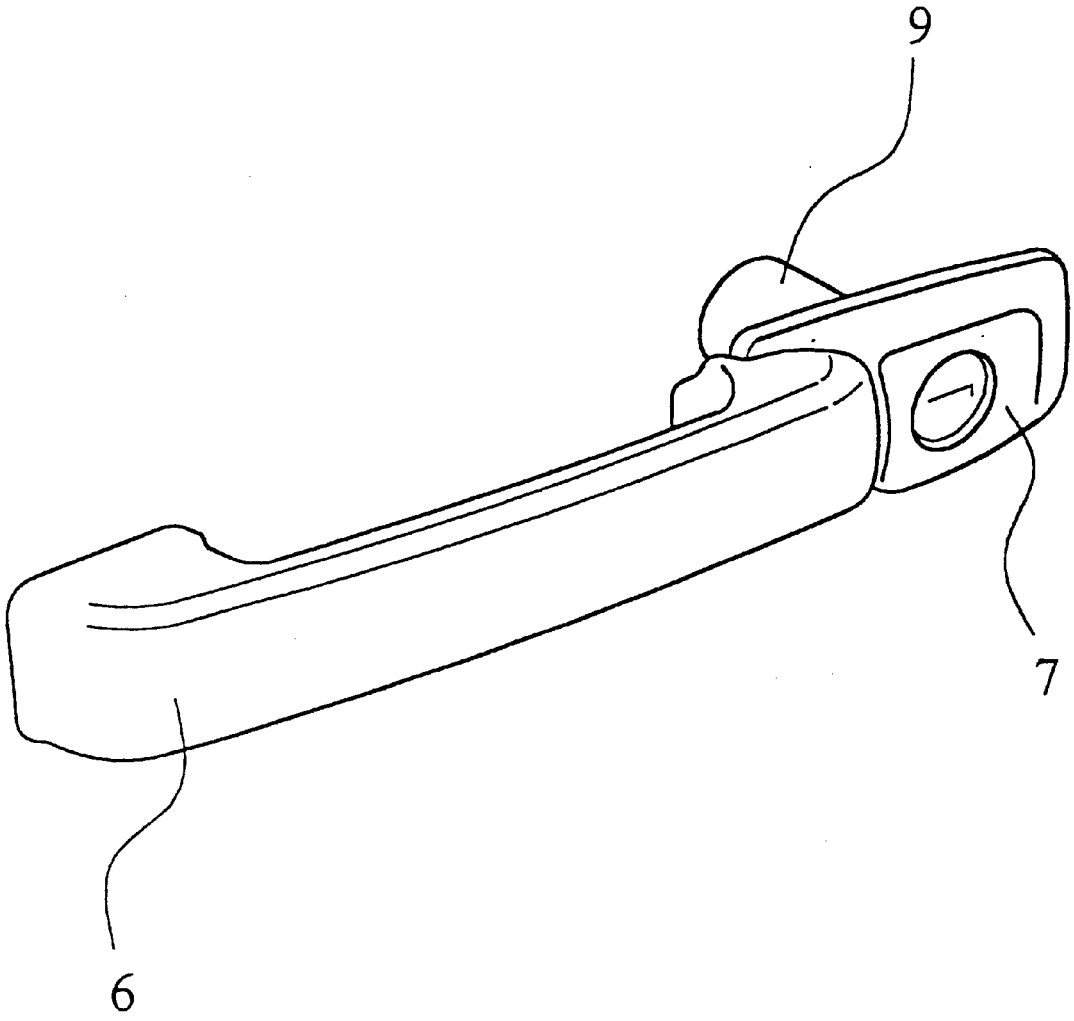
FIG. 2 shows a perspective view of an outside door handle arrangement in a motor vehicle door lock system shown in FIG. 1.

On the motor vehicle body, an outside door handle 6 as shown in FIG. 2 or the like is visible on the respective motor vehicle door. In addition, on the driver-side door, there is a lock cylinder 7 for actuation with a mechanical key 8, this actuation taking place in an emergency to unlock or optionally open the door.

As previously already explained regarding the prior art to which the present invention may be applied, the motor vehicle door lock system with its control electronics 3 requires time to complete a reaction phase with a starting interval, an authorization check interval and an action interval, all of which occurs during the unlocking of the motor vehicle lock 2.

As discussed above in reference to the prior art, initiating the starting interval of the control electronics 3 by the hand of an operator touching the outside door handle 6 has already been accomplished. FIG. 2 shows a typical door handle arrangement of a motor vehicle door lock system of the type under consideration with the outside door handle 6 and the lock cylinder 7. A switching means 9 on the outside door handle 6 is also shown, with which an operating signal is triggered when the outside door handle 6 is pulled in order to trigger an electrical opening drive (not shown) to lift the detent pawl (not shown), again, the details of which being known in the prior art and omitted here. This is a version of an electric lock. In a mechanically activated lock, there is a transmission mechanism of the conventional design instead of the switching means 9.

Figure 3:
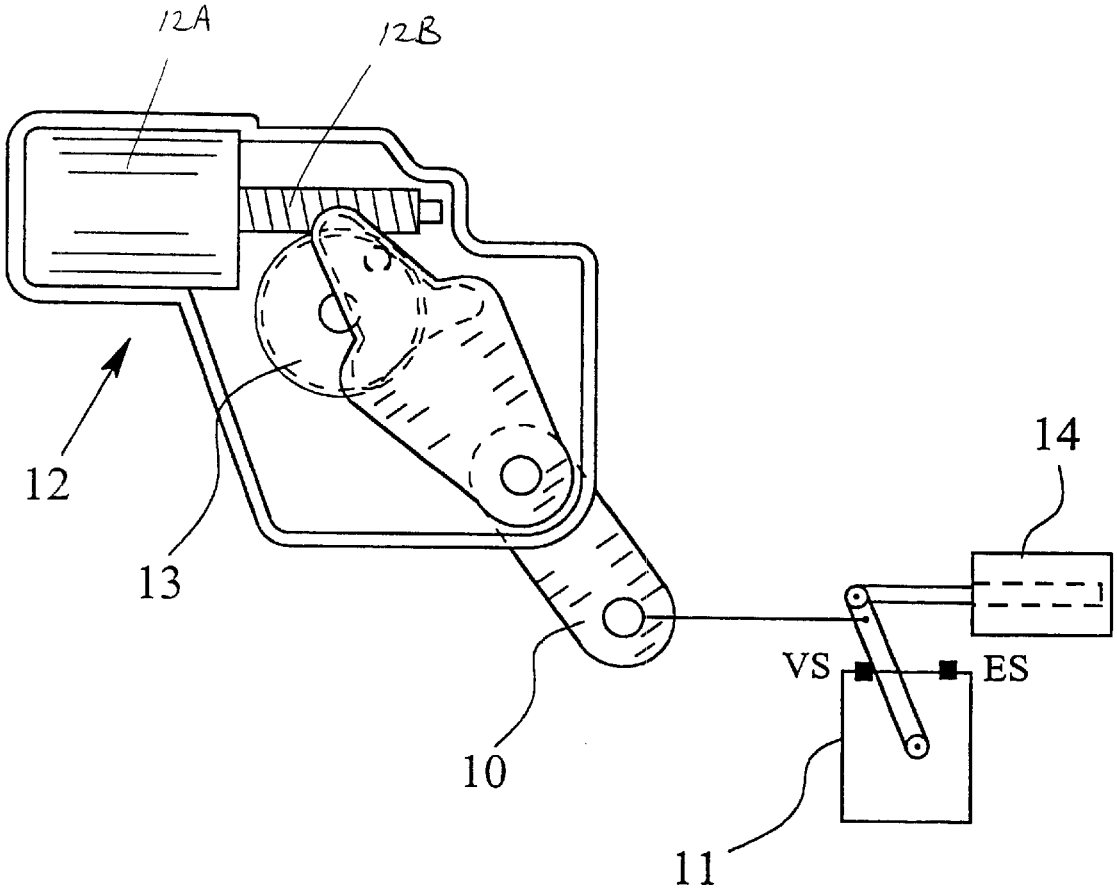
FIG. 3 shows a schematic view of a motor vehicle lock with a central interlock drive and a high-speed electromagnetic drive according to one embodiment of the present invention.

FIG. 3 shows that at this point, the motor vehicle lock 2 of the motor vehicle door lock system in accordance with the embodiment of the present invention shown includes a lock element 10 which can be adjusted between a locking position and an unlocking position. As FIG. 3 shows, the lock element 10 is coupled to the remaining lock mechanism 11, this lock mechanism 11 not requiring any further explanation. The lock element 10 is moved out of the locking position into an unlocking position and vice versa by means of a preferably electrical central interlock drive 12 shown here with a drive element 13 which is typically slow running. The locking position is shown by the letters VS while the unlocking position is shown by the letters ES on the lock mechanism 11.

In the locking position, the motor vehicle lock 2 cannot be opened while in the unlocking position of the lock element 10, the vehicle lock 2 can be opened. How this opening takes place, whether mechanically or by motor, is not significant in practicing the present invention and thus, need not be detailed any further. In this respect, the various alternatives of the prior art can be implemented here to effectuate the locking and unlocking.

The embodiment of the present invention illustrated in FIG. 3 shows that the electrical central interlock drive 12 includes an electrical drive motor 12A and a worm gear 12B pair, with a worm wheel which forms the slowly running drive element 13 for the lock element 10. Alternatives for the corresponding central interlock drive 12 may be used instead such as linear drives with a threaded spindle as the slow running drive element 13. Also pneumatic central interlock drives 12 which are known can also alternatively be used. It is important that the slowly running drive element 13 can move the lock element 10 back and forth between the locking position and the unlocking position. However, as noted previously, such movement occurs relatively slowly.

In accordance with the present invention, the motor vehicle door lock system with a passive entry function is provided with a high-speed electromagnetic drive 14, shown in FIG. 3 schematically as a lifting magnet. The electromagnetic drive 14 is assigned to the lock element 10 in addition to the central interlock drive 12, the electromagnet drive being adapted to move the lock element 10 out of the locking position into the unlocking position in a much shorter time than possible with the drive element 13.

As already explained in the background above, the length of the reaction phase when the motor vehicle lock is being unlocked is more problematic than when the motor vehicle lock is being locked since such locking is essentially unnoticed by the operator. The high-speed electromagnetic drive 14 is therefore, used for unlocking the motor vehicle lock and thus, to move the locking element 10 out of the locking position into the unlocking position.

When the control electronics 3 passes through its reaction phase, the high-speed electromagnetic drive 14 is immediately actuated at the start of the action interval so that the lock element 10 is moved out of the locking position into the unlocking position. This takes place very fast with the high-speed electromagnetic drive 14 which in the present embodiment, is a lifting magnet. In particular, the unlocking occurs in a few milliseconds such as approximately 10 ms. The slow running central interlock drive 12 also provided follows with a time delay so that after the reaction time which is typical for the central interlock drive 12 has passed, the two drives are again synchronous. In the illustrated embodiment, the central interlock drive 12 with its drive element 13 can then be used in the conventional manner for locking of the motor vehicle lock 2. Thus, the drive element 13 can be used to return the lock element 10 from the unlocked position into the locked position where the reaction time is not as critical since such locking is typically not perceived by the operator.

The central interlock drive 12 may be used to handle the unlocking, therefore the movement of the lock element 10 out of the locking position into the unlocking position in vehicle locks 2 on a motor vehicle in situations where the unlocking has not been actuated by the operator directly, for example, opening of the passenger-side door and on the two rear side doors.

In terms of circuitry, the central interlock drive 12 may only be started when the lock element 10 has reached the unlocking position. In such an embodiment, when the control electronics 3 present in the motor vehicle door lock system recognizes the unlocking position, the control electronics 3 can then follow up with the actuation of the central interlock drives 12.

In accordance with another alternative embodiment of the present invention, the high-speed electromagnetic drive 14 may have two de-energized stable positions so that the lock element 10 can be moved out of the unlocked position into the locked position as well as from the locked position into the unlocked position. One such double-stroke lifting magnet with two de-energized stable positions that can be used in accordance with the present invention is known in the prior art and its details need not be discussed further here. However, such an embodiment would be more expensive than that of a simple lifting magnet as used in the illustrated embodiment of FIG. 3.

The teachings of the present invention is especially important when there is a possibility of concealing at least a part of the reaction time required by the control electronics 3 while not utilizing a proximity sensor. The present invention can also be readily applied to a motor vehicle door lock system in which the starting interval is initiated by the hand of the operator activating the outside door handle 6, especially just by touching it.

It is again noted that whether this high-speed electromagnetic drive 14 directly engages the lock element 10 or other components of the motor vehicle lock which are coupled to the lock element 10, for example, a rod which leads to the inside safety buttons, is not critical to practice the present invention. By practicing the present invention, the unlocking position of the lock element 10 and thus, of the entire motor vehicle lock, is reached within a few milliseconds such as approximately 10 ms, after the completion of the authorization check interval by means of the high-speed electromagnetic drive 14. Thus, with the slight additional cost in the motor vehicle lock incurred by the use of a high-speed electromagnetic drive 14, preferably in the form of a lifting magnet, a major improvement in ease of use for the operator is achieved. Instead of 150 ms required in the best possible case of a passive entry system of the existing prior art designs, the reaction phase is now only 100 to 110 ms. In addition, the present invention can also be readily applied to motor vehicle door lock systems which is equipped with a proximity sensor to further shorten the reaction phase of the control electronics, at least with respect to the delay perceived by the operator.

It should be appreciated that the subject matter of the present invention is not only a motor vehicle door lock system overall, but also a motor vehicle lock which is individualized functionally in accordance with the present invention by preferably providing an electrical central interlock drive 12 with the slow running drive element 13 assigned to the control element 10 together with the above explained high-speed electromagnetic drive 14 such as a lifting magnet.

While various embodiments in accordance with the present invention have been shown and described, it is understood that the invention is not limited thereto. These embodiments may be changed, modified and further applied by those skilled in the art. Correspondingly, this invention is not limited to the details shown and described previously but also includes all such changes and modifications which are encompassed by the appended claims.

I claim:

1. A motor vehicle door lock system comprising:

a vehicle lock adapted to be locked and unlocked;

a lock element adapted to be moved between a locked position and an unlocked position for locking and unlocking, respectively, said vehicle lock;

a central interlock drive having a slow running drive element for moving said lock element to lock and unlock said vehicle lock;

a remote control module;

control electronics with a passive entry function to at least passively unlock said vehicle lock, and having means for sensing the remote control module in a reaction phase having an operator initiated starting interval, means for determining access authorization based on information from the remote control module in an authorization check interval, and means for initiating unlocking of the vehicle lock in an action interval; and a high-speed lifting magnet rapidly moving said lock element from said locked position to said unlocked position to thereby unlock said vehicle lock quicker than by operating said drive element of said central interlock drive, said lifting magnet having a de-energized stable position corresponding to the locked position of the lock element;

wherein said lifting magnetic is immediately activated by said means for initiating unlocking upon starting of said action interval, and said central interlock drive is operated subsequent to said activation to move said slow running drive element to a position corresponding to said unlocked position of said lock element, and wherein the lock element is adapted to be returned from the unlocked position to the locked position for locking of said vehicle lock by only the drive element of the central interlock drive.

2. The motor vehicle door lock system of claim 1, wherein said central interlock drive is operated only when said lock element is in said unlocked position.

3. The motor vehicle door lock system of claim 1, further comprising an outside door handle;

wherein said action interval is started by the hand of the operator actuating said outside door handle.

* * * * *